US008449052B2

(12) United States Patent
Briggs et al.

(10) Patent No.: US 8,449,052 B2
(45) Date of Patent: May 28, 2013

(54) DRAWER ASSEMBLY

(76) Inventors: Matt Briggs, Salt Lake City, UT (US); Angelo Gianelo, Salt Lake City, UT (US)

( * ) Notice: Subject to any disclaimer, the term of this patent is extended or adjusted under 35 U.S.C. 154(b) by 190 days.

(21) Appl. No.: 12/650,339

(22) Filed: Dec. 30, 2009

(65) Prior Publication Data

US 2010/0253192 A1 Oct. 7, 2010

Related U.S. Application Data

(60) Provisional application No. 61/141,634, filed on Dec. 30, 2008.

(51) Int. Cl.
*A47B 88/00* (2006.01)

(52) U.S. Cl.
USPC ..... 312/348.1; 312/330.1; 312/348.6

(58) Field of Classification Search
USPC ..... 312/330.1, 333, 294, 257.1, 334.1, 312/348.6; 206/464, 465
See application file for complete search history.

(56) References Cited

U.S. PATENT DOCUMENTS 1,352,002 A * 9/1920 Jones ..... 312/348.2
3,337,078 A * 8/1967 Radek ..... 220/6
3,410,441 A * 11/1968 Rhyne ..... 220/4.28
3,591,212 A * 7/1971 Rhyne ..... 217/65
3,675,808 A * 7/1972 Brink ..... 220/7
4,120,551 A * 10/1978 Godtschalck ..... 312/348.1
4,482,074 A * 11/1984 Lalley ..... 220/4.28
5,538,339 A * 7/1996 Rock et al. ..... 312/348.1
5,823,650 A * 10/1998 Lin ..... 312/348.1
6,050,661 A * 4/2000 Fleisch ..... 312/348.1
6,056,380 A * 5/2000 Nien ..... 312/348.1
6,231,141 B1 * 5/2001 Liebertz et al. ..... 312/263
6,328,178 B1 * 12/2001 Hsu ..... 220/7

* cited by examiner

*Primary Examiner* — James O Hansen
*Assistant Examiner* — Sasha T Varghese
(74) *Attorney, Agent, or Firm* — TraskBritt

(57) ABSTRACT

A drawer construction having a floor element surmounted by a plurality of upstanding sidewalls forming a frame includes one or more reinforced connections between the floor element and one or more of the sidewalls. The reinforced connection may include one or more outwardly extending tabs associated with the floor element which are received within appropriately sized and oriented slots defined within a selected sidewall. The sidewall may further include a laterally extending shelf positioned proximate the lower edge of the sidewall and oriented to extend below the floor element such that the floor element rests on the upper surface of the shelf. Mounting supports, positioned on the opposing ends of the sidewall may be secured to adjacently positioned sidewalls to further strengthen the association of the sidewall with the drawer structure.

17 Claims, 5 Drawing Sheets

DRAWER ASSEMBLY

FIELD

This invention relates to drawer assemblies of the type typically found in cabinets. The invention is more specially directed to drawers for use in cabinets adapted for use in storing articles such as tools, and other articles which are relatively heavy.

STATEMENT OF THE ART

Conventional drawer fitted cabinets typically include a cabinet frame which defines a plurality of recesses. Each recess is configured and dimensioned to receive and retain a respective drawer. A common configuration defines a recess having a quadrilateral cross section which is generally constant over the length of the recess. A drawer, constructed to be received in such a recess, generally includes a planar floor element. A common floor element is rectangular in shape having a planar upper as well as lower surface. The floor element defines two side perimeters, positioned opposite from one another. These side perimeters are linear in construction. The floor element also defines a front perimeter and a rear perimeter. The front and rear perimeters are positioned opposite from one another, each of these latter perimeters are also linear in configuration. The side perimeters each intersect the front perimeter and their rear perimeter at right angles.

Four upstanding sidewalls are positioned about the perimeter of the floor element. Each of the sidewalls may be formed by a planar panel having a generally rectangular shape. Each of the ends of a sidewall is coupled with the end of an adjacently positioned sidewall, typically forming a right angle. The sidewalls extend vertically upright thereby forming a quadrilaterally configured frame which extends upwardly from the horizontally positioned floor element. The drawer may be fitted with a guidance structure adapted to retain the drawer in a preselected travel path as the drawer is pulled outwardly from the recess or pushed back into the recess.

When drawers of the conventional construction are utilized in environments wherein the articles being stored within the drawers are relatively heavy, for example industrial tools, the construction of the drawer oftentimes fails under the increased weight demands imposed by these articles. The floor element typically separates from its connection with the sidewalls in this event, resulting in the contents of the drawer being scattered as the floor disassociates from the remainder of the drawer assembly. It follows that in industrial cabinets, of the type traditionally found in automobile service shops, industrial trucks fitted with storage cabinets, and other service related environments, there exists a need for storage drawers which have the ability to provide enhanced resistance to the loads exerted by relatively heavy articles being stored within such cabinets and specifically the drawers of such cabinets.

SUMMARY OF THE INVENTION

A drawer assembly of the invention includes a floor element having at least one outwardly extending tab disposed along a perimeter of the floor element. A plurality of upstanding sidewalls is disposed about the floor element to extend upwardly therefrom. At least one of the sidewalls defines an elongate slot therein dimensioned to receive the tab. The tab is inserted into the slot thereby forming a support for the floor element. The tab may extend through the slot. The sidewall may further include a laterally extending shelf, configured near its lower edge, which extends below the floor element sufficient to form a support upon which the floor element may rest. In a further embodiment of the invention the ends of the sidewall may be configured to form mounting surfaces for securement with adjacently positioned sidewalls to provide further enhancement of the connection of the sidewalls to the floor element of the drawer.

DETAILED DESCRIPTION OF THE ILLUSTRATED EMBODIMENT

Figure 1:
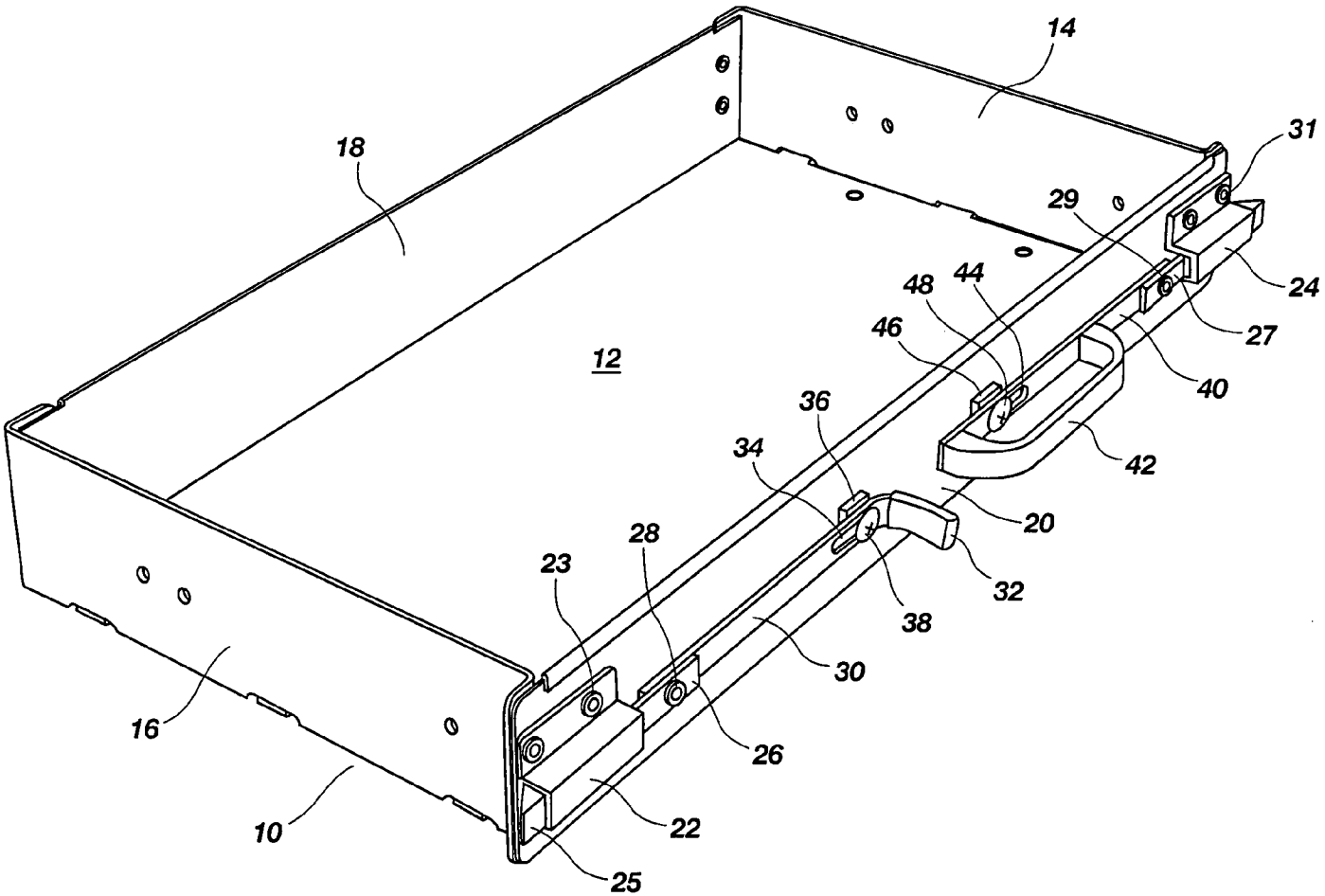
FIG. 1 is a perspective view of a drawer assembly of the invention.

As shown in FIG. 1 a drawer assembly 10 of the invention includes a floor element 12, a right sidewall 14, a left sidewall 16, a rear sidewall 18 and a front sidewall 20. The sidewalls 14, 16, 18 and 20 together form a quadrilaterally configured frame like structure. The sidewalls are positioned uprightly about the perimeter of the floor element 12 to form a drawer having an open interior configured for receiving and retaining articles to be stored.

Figure 4:
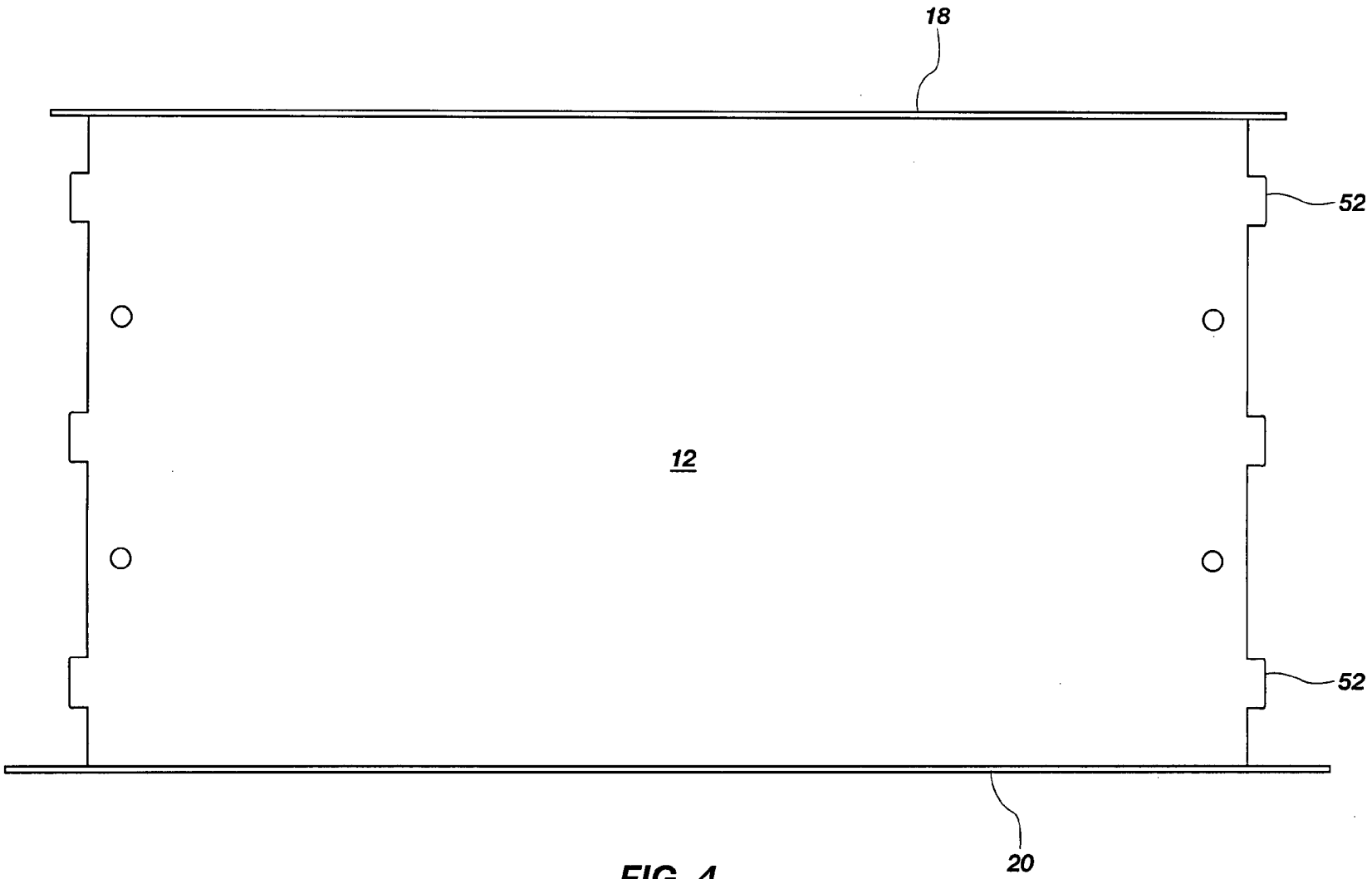
FIG. 4 is a top view of the drawer assembly of FIG. 1 with the sidewalls removed for clarity.

As shown in FIGS. 1 and 4, the floor element 12 is a flat panel having a planar upper surface. The bottom surface of the floor element 12 is substantially identical to the upper surface, i.e. it is planar in configuration. The floor element is generally rectangular in shape as shown in FIG. 4 with the exception of a number of generally rectangularly configured tabs 52 which extend outwardly, in the plane of the floor element, from the perimeter of the floor element. The tabs 52 are spacedly positioned along the length of the right and left sides of the floor element. While the tabs 52 are illustrated as extending from the left and right sides of the floor elements, it should be understood that it is also contemplated that such tabs 52 may also be constructed to be spacedly arranged along the rear and/or front perimeters of the floor element 12 as well. In sum, the floor element 12 may be fitted with one or more tabs 52 which may be positioned along one or more of its perimeters.

In one embodiment of the invention, the tabs 52 are formed integrally with the floor surface 12. In other constructions, the tabs 52 may be separate elements which are secured to the floor element by suitable securement means, e.g. welding.

Alternatively, other securement means such as adhesives, or mechanical connectors may be utilized. The drawer may be fabricated of any rigid or semi-rigid material such as steel or other metal or alternatively, plastic, fiberglass or other rigid or semi-rigid material.

Figure 7:
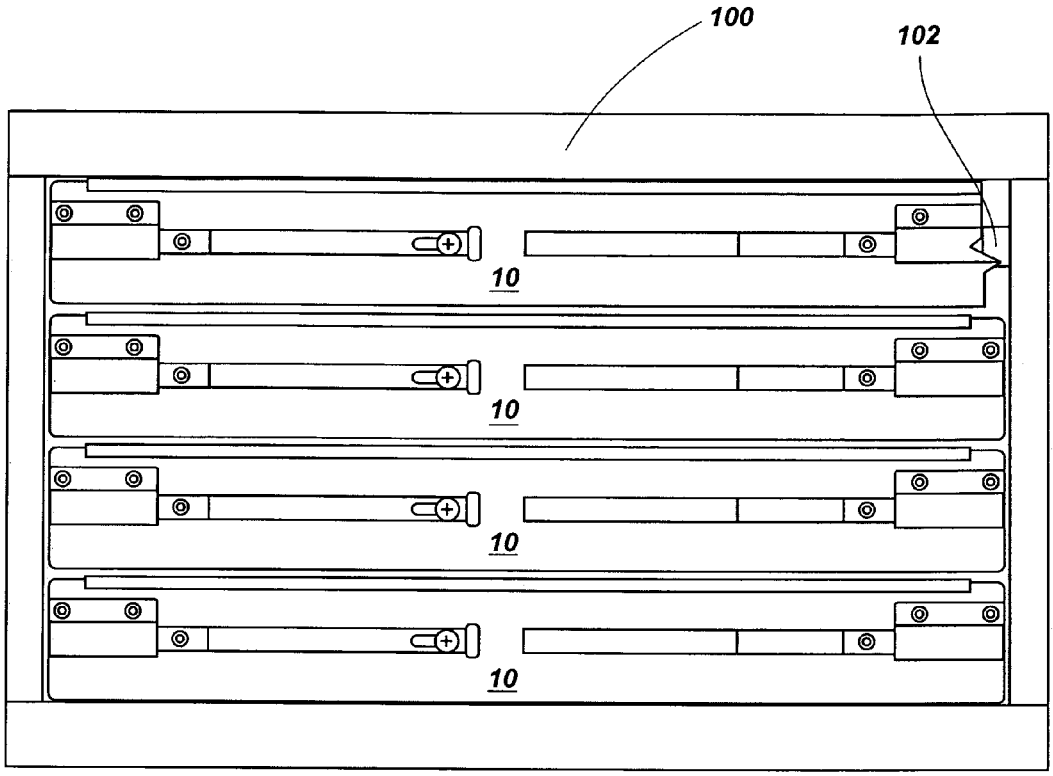
FIG. 7 is a front view of the drawer assembly of FIG. 1 shown in a cabinet with a portion of a front sidewall of one drawer assembly cutaway.

The front sidewall of the drawer 20 may be fitted with a handle and locking mechanism of the type shown in FIG. 1. As illustrated, a pair of brackets 22 formed of generally "U"

shaped elements having laterally extending wings extending from the upper portion of the U-shaped element are secured to the face of the front sidewall 20 by securement elements 23, which may be rivets which pass through the brackets 22 as well as the front sidewall 20. In association with the front surface of the front sidewall 20 the brackets 22 define a passageway in which is positioned a latch member 25 which is displaceable mounted for lateral displacement. The latch 25 is adapted to engage suitable structure in the cabinet frame to retain the drawer in a fixed position within the cabinet (e.g., cabinet 100 including drawer assemblies 10 having guide mechanism 102 for controlling the path of travel of a drawer assembly 10 within the cabinet 100 as shown in FIG. 7) until the latch is disengaged from its locked position with the cabinet frame. The latch member 25 includes an internal spring which biases the latch member into an outwardly extending orientation. The latch member 25 is secured to a laterally extending support 26 which is secured to a second support 30 by a securement, e.g. rivet, 28.

The second support 30 defines an elongate slot therein 34 which slidably receives a blot 38. The bolt 38, in turn, is secured within a mounting 36 which is secured in the front sidewall 20. Due to its sliding securement with the bolt 38, the second support 30 is permitted to be displaced laterally toward and away from the bracket 25 fitted on the left end of the front sidewall 20. The end of the second support 30 is bent generally at an angle of ninety degrees to form a handle 32 which may be grasped by the user to apply a laterally directed force to the latch member 25 through intermediation of the second support 30 and support 26. As the handle 32 is pulled to the right, the latch member 25 is withdrawn into the passageway defined within the bracket 22 thereby disengaging itself with the frame of the cabinet which is typically positioned adjacent to the upright edge of the front face of the front sidewall 20.

The right side of the front sidewall 20 is likewise fitted with a bracket 24 which corresponds structure wise with the bracket 22 previously described. A support 27 is secured to a latching member which is housed within the bracket 24. The bracket is secured to the front sidewall 20 by securement members 31 which may be rivets which pass through the bracket and into the front sidewall 20. A secondary support 40 is secured to the support 27 by a rivet 29. This secondary support 40 is slidably secured to the front sidewall 20 by a bolt 48 which passes through an elongate slot 44 defined within the support 40. This securement permits a lateral sliding displacement of the secondary support 40 along the face of the front sidewall 20. The bolt 48 is secured to the front sidewall by a mounting bracket 46. The secondary support 40 is fitted with a generally "U" shaped handle 42 which provides the user with a means of grasping the secondary support and displacing that support to the left. The orientation of the handles 32 and 42 permit a user to grasp both handles with a single hand and upon urging the two handles toward one another cause the latching members located on the ends of supports 26 and 27 to be disengaged from their engagements with the cabinet side frame.

Figure 2:
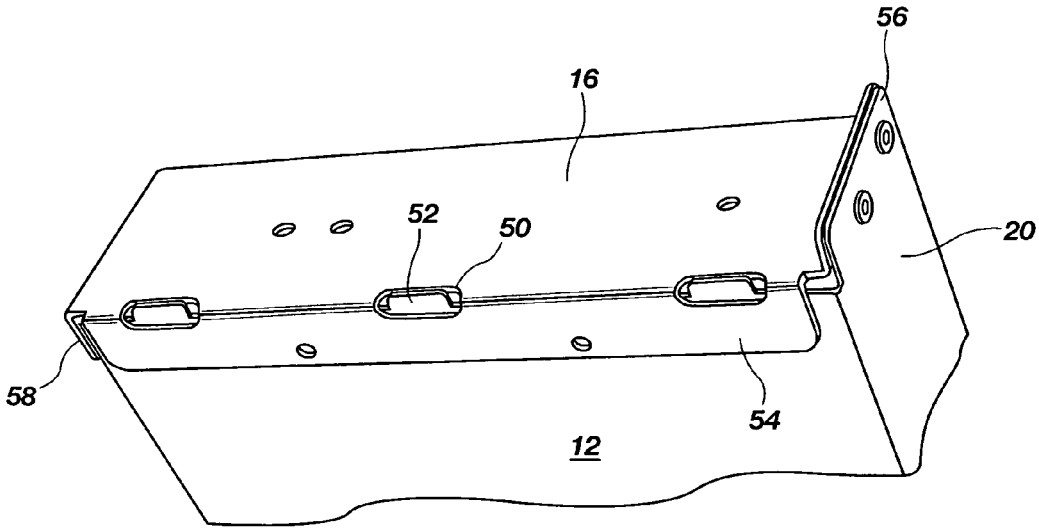
FIG. 2 is a partial sectional view of the drawer of FIG. 1 showing the left sidewall and a portion of the floor element and the front sidewall.

FIG. 2 illustrates the construction of the left sidewall 16 of the drawer. As shown the left sidewall includes a central planar portion having a generally rectangular configuration. The outwardly extending face of the sidewall is planar as is the inner facing face of the sidewall. The forward end of the sidewall is bent at approximately ninety degrees to form a mounting surface 56 which engages the inside surface of the front sidewall 20. The mounting surface 56 is secured to the front sidewall 20 by suitable securement means, such as the two rivets as shown. The lower surface of the left sidewall 16 defines a mounting surface 54 which is formed by bending the lower portion of the left sidewall substantially ninety degrees. The mounting surface 54 forms a shelf on which rests the lower surface of the floor element 12. Spacedly positioned within the left sidewall 16 along the length of that sidewall are a plurality of elongate slots 50 which are each dimensioned to receive a respective tab 53 of the floor element 12. The slots 50 may be dimensioned to correspond generally to the width of the tabs such that upon an insertion of a tab into a respective slot 50 the dimensioning of the slot 50 precludes any significant lateral movement of the tab within the slot. The tabs rests on the lower edge of the slot formed in the sidewall 16 thereby forming a support for the floor element 12. The rear end of the sidewall 16 is likewise bent approximately ninety degrees to form a mounting surface 58, shown to advantage in FIG. 3. This mounting surface 58 is secured to the rear sidewall 18 by suitable securement means, e.g. the two rivets as shown.

Figure 3:
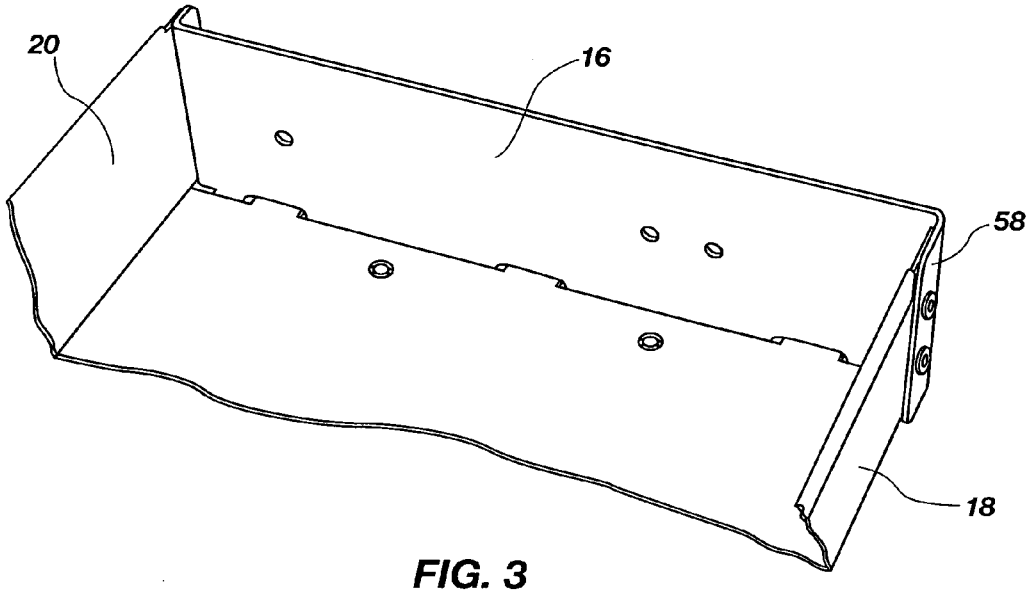
FIG. 3 is a partial sectional view of the drawer assembly of FIG. 1 showing the interior of the left sidewall.
Figure 5:
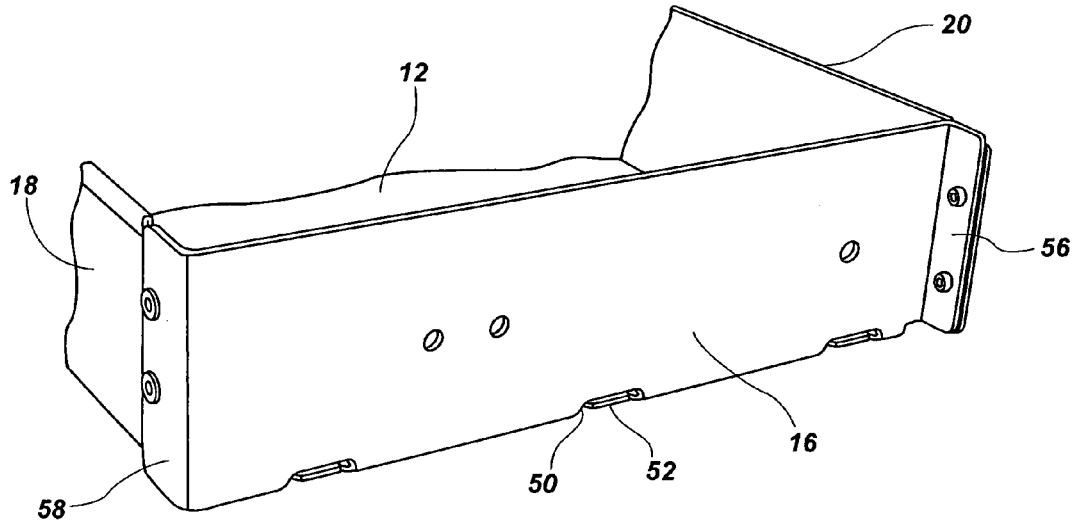
FIG. 5 is a partial sectional view taken from a perspective view of the left sidewall.
Figure 6:
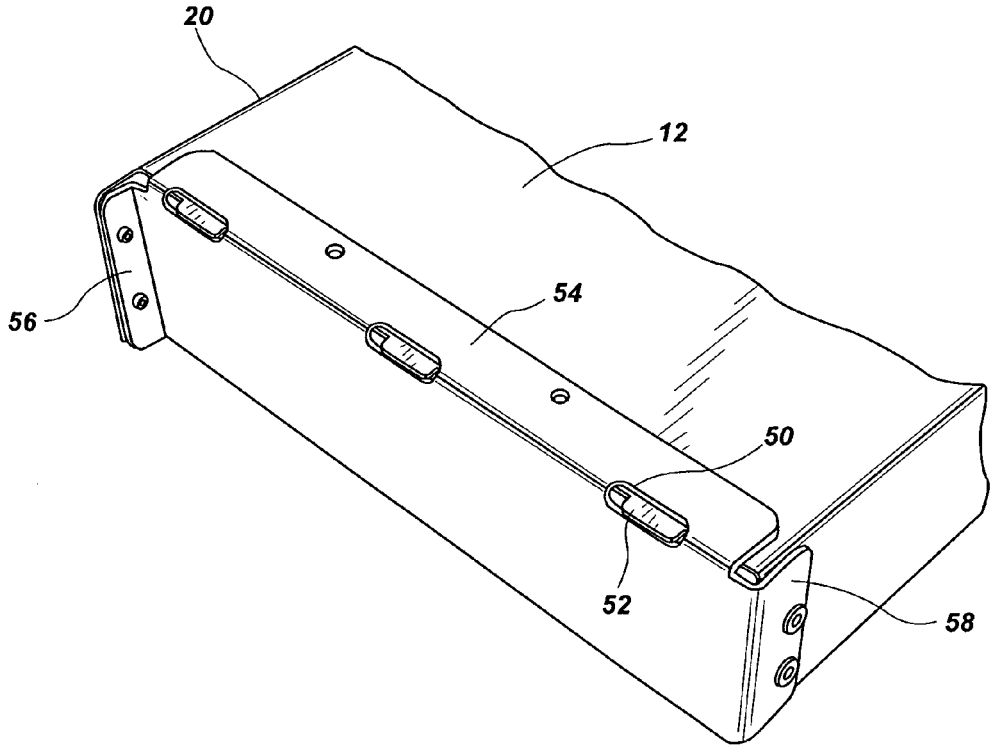
FIG. 6 is a perspective, partial sectional view of the bottom of the drawer assembly of FIG. 1.

As shown to advantage in FIGS. 2 and 3, the left sidewall 16 is securedly coupled to the front sidewall 20 by the rivets which pass through the front sidewall wall 20 and are secured into the mounting surface 56. The sidewall 16 is secured to the floor element by the interaction of the tabs 52 with the slots 50. Furthermore, the floor element 12 rests atop the mounting surface or shelf 54. Lastly, the sidewall 16 is secured to the rear sidewall 18 by the rivets which pass through the mounting surface 58 and into the sidewall 18. The securement of the sidewall 16 to the front sidewall 20, floor element 12 and rear sidewall 18 is further shown in FIGS. 5 and 6. The right sidewall may be secured to the front sidewall 20, floor element 12 and rear sidewall 18 in a similar manner to that previously described with reference to the securement of the left sidewall 16 to those structures.

In another embodiment of the invention, the rear sidewall 18 may be further secured to the floor element by the provision of a mounting surface which corresponds to that of mounting surface 54 of sidewall 16. In this instance, the sidewall 18 would be bent proximate its lower edge in a manner similar to that of sidewall 16 to approximately ninety degrees to form a mounting surface having the general configuration of mounting surface 54 of sidewall 16. In this particular instance, the ends of the mounting surface may be cut back in order to avoid any overlap with the mounting surface 54 of sidewall 16 and sidewall 14 proximate the ends of sidewall 18. In this alternative construction, the rear sidewall 18 would be also be configured to define one or more elongate slots 50 each being dimensioned and oriented to receive a respective tab 52 carried by floor element 12. Similarly, the floor element 12 may be fitted with tabs 52 which extend rearwardly which would then facilitate a similar connection of the rear sidewall 18 in a manner similar to that previously described with reference to sidewall 16 with floor element 12.

In yet a further embodiment of the invention a connection of the floor element with the front sidewall 20 utilizing a tab 52 and corresponding slot arrangement 50 may be constructed together with a suitable shelf construction fabricated by bending the front sidewall proximate its lower region ninety degrees to define a shelf corresponding generally to that of shelf 54 of sidewall 16.

It follows that consistent with the provisions of the instant invention, a drawer may be constructed to include one or more strengthened connections between an upstanding sidewall of the drawer and the underlying floor element by positioning tabs extending outwardly from the floor element sized to be received with appropriately sized slots defined within the sidewall. The sidewall may also include a laterally extending shelf defined proximate the lower region of that element which is dimensioned and sized to extend below the floor element to provide a support structure upon which the floor element may rest. The connection may be supplemented by support members defined on or more of the ends of the sidewall which wrap around an adjoining sidewall, positioned proximate the end of the sidewall and are secured to that adjoining sidewall by suitable securement members.

It should be appreciated that the above description of the instant invention is illustrative of the invention and is not intended to be restrictive of the scope of the invention which is solely determined by the claims which are appended hereto.

The invention claimed is:

1. A drawer assembly comprising:

a floor element comprising:

a bottom surface;

at least two outwardly extending right tabs disposed along a perimeter of the bottom surface of the floor element on a first lateral side;

at least two outwardly extending left tabs disposed along the perimeter of the bottom surface of the floor element on a second lateral side opposing the first lateral side;

a rear sidewall integrally formed with the bottom surface and extending upwardly from the bottom surface of the floor element in a direction perpendicular to the bottom surface, the rear sidewall extending along the perimeter of the bottom surface of the floor element at a rear portion of the floor element and extending between the first lateral side and the second lateral side of the floor element; and a front sidewall integrally formed with the bottom surface and extending upwardly from the bottom surface of the floor element in a direction perpendicular to the bottom surface, the front side wall extending along the perimeter of the bottom surface of the floor element at a front portion of the floor element and extending between the first lateral side and the second lateral side of the floor element;

a first lateral sidewall positioned along the perimeter of the bottom surface of the floor element at the first lateral side, the first lateral sidewall extending upwardly from the bottom surface in a direction perpendicular to the bottom surface and extending between the front sidewall and the rear sidewall of the floor element along the first lateral side, wherein the first lateral sidewall comprises at least two elongate slots extending through at least a vertical portion of the first lateral sidewall, wherein each tab of the at least two outwardly extending right tabs is received in one elongate slot of the at least two elongate slots of the first lateral sidewall to support the floor element; and a second lateral sidewall positioned along the perimeter of the bottom surface of the floor element at the second lateral side, the second lateral sidewall extending upwardly from the bottom surface in a direction perpendicular to the bottom surface and extending between the front sidewall and the rear sidewall of the floor element along the second lateral side, wherein the second lateral sidewall comprises at least two elongate slots extending through at least a vertical portion of the second lateral sidewall, wherein each tab of the at least two outwardly extending left tabs is received in one elongate slot of the at least two elongate slots of the second lateral sidewall to support the floor element;

wherein the first lateral sidewall further comprises a first laterally extending shelf element extending inwardly from the first lateral sidewall in a direction perpendicular to the first lateral sidewall and parallel to the rear sidewall and the front sidewall to a position beneath the bottom surface of the floor element, the first laterally extending shelf element positioned elevationally below the at least two outwardly extending right tabs and the floor element, wherein the second lateral sidewall further comprises a second laterally extending shelf element extending inwardly from the second lateral sidewall in a direction perpendicular to the second lateral sidewall and parallel to the rear sidewall and the front sidewall to a position beneath the bottom surface of the floor element, the second laterally extending shelf element positioned elevationally below the at least two outwardly extending left tabs and the floor element, wherein the first laterally extending shelf element and the second laterally extending shelf element form a secondary support for the floor element; and wherein each elongate slot of the at least two elongate slots of the first lateral sidewall is formed at an intersection between the vertical portion of the first lateral sidewall and the first laterally extending shelf element, and wherein each elongate slot of the at least two elongate slots of the second lateral sidewall is formed at an intersection between the vertical portion of the second lateral sidewall and the second laterally extending shelf element.

2. The drawer assembly of claim 1, wherein each elongate slot of the at least two elongate slots of the first lateral sidewall extends through a portion of the vertical portion of the first lateral sidewall and a portion of the first laterally extending shelf element, and wherein each elongate slot of the at least two elongate slots of the second lateral sidewall extends through a portion of the vertical portion of the second lateral sidewall and a portion of the second laterally extending shelf element.

3. The drawer assembly of claim 2, wherein each elongate slot of the at least two elongate slots of the first lateral sidewall is entirely encompassed and bounded by a portion of the first lateral sidewall and a portion of the first laterally extending shelf element, and wherein each elongate slot of the at least two elongate slots of the second lateral sidewall is entirely encompassed and bounded by a portion of the second lateral sidewall and a portion of the second laterally extending shelf element.

4. The drawer assembly of claim 1, wherein the at least two elongate slots of the first lateral sidewall and the at least two elongate slots of the second lateral sidewall each comprise three elongate slots, and wherein the at least two outwardly extending right tabs of the floor element and the at least two outwardly extending left tabs of the floor element each comprise three tabs.

5. The drawer assembly of claim 1, wherein the first lateral sidewall further comprises a first laterally extending mounting element extending outwardly from the first lateral sidewall in a direction perpendicular to the first lateral sidewall, wherein the first laterally extending mounting element is coupled to the front sidewall of the floor element, and wherein the second lateral sidewall further comprises a second laterally extending mounting element extending outwardly from the second lateral sidewall in a direction perpendicular to the second lateral sidewall, wherein the second laterally extending mounting element is coupled to the front sidewall of the floor element.

6. The drawer assembly of claim 5, wherein the first lateral sidewall further comprises a first laterally extending rear mounting element extending inwardly from the first lateral sidewall in a direction perpendicular to the first lateral sidewall, wherein the first laterally extending rear mounting element is coupled to the rear sidewall of the floor element, and wherein the second lateral sidewall further comprises a second laterally extending rear mounting element extending inwardly from the second lateral sidewall in a direction perpendicular to the second lateral sidewall, wherein the second laterally extending rear mounting element is coupled to the rear sidewall of the floor element.

7. The drawer assembly of claim 6, wherein the first laterally extending mounting element and the second laterally extending mounting element are riveted to the front sidewall of the floor element, and wherein the first laterally extending rear mounting element and the second laterally extending rear mounting element are riveted to the rear sidewall of the floor element.

8. The drawer assembly of claim 1, further comprising a locking mechanism coupled to the front sidewall of the floor element for retaining and securing the drawer assembly in a predetermined orientation within a cabinet.

9. The drawer assembly of claim 8, wherein the locking mechanism comprises:

a first latching member positioned on a first lateral portion of the front sidewall of the floor element; a second latching member positioned on a second lateral portion opposing the first lateral portion of the front sidewall of the floor element;

a first handle coupled to the first latching member; and a second handle coupled to the second latching member, the first handle being positioned proximate the second handle, wherein the first handle and the second handle are configured for displacement toward one another to unlatch the first latching member and the second first latching member.

10. A cabinet comprising a plurality of drawer assemblies disposed therein, each drawer assembly of the plurality of drawer assemblies comprising the drawer assembly of claim 1.

11. A drawer assembly comprising:

a floor element having at least two outwardly extending right tabs disposed along a perimeter of the floor element on a first lateral side and at least two outwardly extending left tabs disposed along the perimeter of the floor element on a second lateral side opposing the first lateral side;

a rear sidewall extending upwardly from the floor element in a direction perpendicular to the floor element, the rear sidewall extending along the perimeter of the floor element at a rear portion of the floor element and extending between the first lateral side and the second lateral side of the floor element;

a front sidewall extending upwardly from the floor element in a direction perpendicular to the floor element, the front side wall extending along the perimeter of the floor element at a front portion of the floor element and extending between the first lateral side and the second lateral side of the floor element;

a first lateral sidewall positioned along the perimeter of the floor element at the first lateral side, the first lateral sidewall extending upwardly from the floor element in a direction perpendicular to the floor element and extending between the front sidewall and the rear sidewall of the floor element along the first lateral side, the first lateral sidewall comprising:

at least two elongate slots extending through at least a vertical portion of the first lateral sidewall, wherein each tab of the at least two outwardly extending right tabs is received in one elongate slot of the at least two elongate slots of the first lateral sidewall to support the floor element; and a first laterally extending shelf element extending inwardly from the first lateral sidewall in a direction perpendicular to the first lateral sidewall and parallel to the rear sidewall and the front sidewall, the first laterally extending shelf element positioned elevationally below the at least two outwardly extending right tabs and the floor element, wherein the first laterally extending shelf element forms a secondary support for the floor element; and a second lateral sidewall positioned along the perimeter of the floor element at the second lateral side, the second lateral sidewall extending upwardly from the floor element in a direction perpendicular to the floor element and extending between the front sidewall and the rear sidewall of the floor element along the second lateral side, the second lateral sidewall comprising:

at least two elongate slots extending through at least a vertical portion of the second lateral sidewall, wherein each tab of the at least two outwardly extending left tabs is received in one elongate slot of the at least two elongate slots of the second lateral sidewall to support the floor element; and a second laterally extending shelf element extending inwardly from the second lateral sidewall in a direction perpendicular to the second lateral sidewall, the second laterally extending shelf element positioned elevationally below the at least two outwardly extending left tabs and the floor element, wherein the second laterally extending shelf element forms another secondary support for the floor element;

wherein each elongate slots of the at least two elongate slots of the first lateral sidewall is formed at an intersection between the vertical portion of the first lateral sidewall and the first laterally extending shelf element, and wherein each elongate slot of the at least two elongate slots of the second lateral sidewall is formed at an intersection between the vertical portion of the second lateral sidewall and the second laterally extending shelf element.

12. The drawer assembly of claim 11, wherein the rear sidewall and the front sidewall are integrally formed with the floor element.

13. The drawer assembly of claim 11, wherein the first lateral sidewall further comprises:

a first laterally extending front mounting element extending outwardly from the first lateral sidewall in a direction perpendicular to the first lateral sidewall and opposite to the first laterally extending shelf element, wherein the first laterally extending front mounting element is coupled to the front sidewall of the floor element; and a first laterally extending rear mounting element extending inwardly from the first lateral sidewall in a direction perpendicular to the first lateral sidewall and in direction opposite to the first laterally extending front mounting element, wherein the first laterally extending rear mounting element is coupled to the rear sidewall of the floor element; and wherein the second lateral sidewall further comprises:

a second laterally extending front mounting element extending outwardly from the second lateral sidewall in a direction perpendicular to the second lateral sidewall and opposite to the second laterally extending shelf element, wherein the second laterally extending front mounting element is coupled to the front sidewall of the floor element; and a second laterally extending rear mounting element extending inwardly from the second lateral sidewall in a direction perpendicular to the second lateral sidewall and in direction opposite to the second laterally extending front mounting element, wherein the second laterally extending rear mounting element is coupled to the rear sidewall of the floor element.

14. The drawer assembly of claim 11, wherein each elongate slot of the at least two elongate slots of the first lateral sidewall extends through a portion of the vertical portion of the first lateral sidewall and a portion of the first laterally extending shelf element, and wherein each elongate slot of the at least two elongate slots of the second lateral sidewall extends through a portion of the vertical portion of the second lateral sidewall and a portion of the second laterally extending shelf element.

15. The drawer assembly of claim 11, wherein each elongate slot of the at least two elongate slots of the first lateral sidewall is entirely encompassed and bounded by a portion of the first lateral sidewall and a portion of the first laterally extending shelf element, and wherein each elongate slot of the at least two elongate slots of the second lateral sidewall is entirely encompassed and bounded by a portion of the second lateral sidewall and a portion of the second laterally extending shelf element.

16. The drawer assembly of claim 11, further comprising a locking mechanism coupled to the front sidewall of the floor element for retaining and securing the drawer assembly in a predetermined orientation within a cabinet, the locking mechanism comprising:

a first latching member positioned on a first lateral portion the front sidewall of the floor element;

a second latching member positioned on a second lateral portion opposing the first lateral portion of the front sidewall of the floor element;

a first handle coupled to the first latching member; and a second handle coupled to the second latching member, the first handle being positioned proximate the second handle, wherein the first handle and the second handle are configured for displacement toward one another to unlatch the first latching member and the second first latching member.

17. A drawer assembly comprising:

a floor element having at least two outwardly extending right tabs disposed along a perimeter of the floor element on a first lateral side and at least two outwardly extending left tabs disposed along the perimeter of the floor element on a second lateral side opposing the first lateral side;

a rear sidewall extending upwardly from the floor element in a direction perpendicular to the floor element, the rear sidewall extending along the perimeter of the floor element at a rear portion of the floor element and extending between the first lateral side and the second lateral side of the floor element;

a front sidewall extending upwardly from the floor element in a direction perpendicular to the floor element, the front side wall extending along the perimeter of the floor element at a front portion of the floor element and extending between the first lateral side and the second lateral side of the floor element, wherein the rear sidewall and the front sidewall are integrally formed with the floor element;

a first lateral sidewall positioned along the perimeter of the floor element at the first lateral side, the first lateral sidewall extending upwardly from the floor element in a direction perpendicular to the floor element and extending between the front sidewall and the rear sidewall of the floor element along the first lateral side, wherein the first lateral sidewall comprises:

a first laterally extending shelf element extending from the first lateral sidewall in a direction perpendicular to the first lateral sidewall and parallel to the rear sidewall and the front sidewall, the first laterally extending shelf element positioned elevationally below the at least two outwardly extending right tabs and the floor element, wherein the first laterally extending shelf element forms a secondary support for the floor element;

at least two elongate slots extending through the first lateral sidewall, each elongate slot of the at least two elongate slots being formed at an intersection between the vertical portion of the first lateral sidewall and the first laterally extending shelf element and extending through a portion of the vertical portion of the first lateral sidewall and a portion of the first laterally extending shelf element, wherein each elongate slot of the at least two elongate slots of the first lateral sidewall is entirely encompassed and bounded by a portion of the first lateral sidewall and a portion of the first laterally extending shelf element, and wherein each tab of the at least two outwardly extending right tabs is received in one elongate slot of the at least two elongate slots of the first lateral sidewall to support the floor element;

a first laterally extending front mounting element extending outwardly from the first lateral sidewall in a direction perpendicular to the first lateral sidewall and opposite to the first laterally extending shelf element, wherein the first laterally extending front mounting element is coupled to the front sidewall of the floor element; and a first laterally extending rear mounting element extending inwardly from the first lateral sidewall in a direction perpendicular to the first lateral sidewall and opposite to the first laterally extending front mounting element, wherein the first laterally extending rear mounting element is coupled to the rear sidewall of the floor element;

a second lateral sidewall positioned along the perimeter of the floor element at the second lateral side, the second lateral sidewall extending upwardly from the floor element in a direction perpendicular to the floor element and extending between the front sidewall and the rear sidewall of the floor element along the second lateral side, wherein the second lateral sidewall comprises:

a second laterally extending shelf element extending from the second lateral sidewall in a direction perpendicular to the second lateral sidewall and parallel to the rear sidewall and the front sidewall, the second laterally extending shelf element positioned elevationally below the at least two outwardly extending left tabs and the floor element, wherein the second laterally extending shelf element forms another secondary support for the floor element;

at least two elongate slots extending through the second lateral sidewall, each elongate slot of the at least two elongate slots of the second lateral sidewall being formed at an intersection between the vertical portion of the second lateral sidewall and the second laterally extending shelf element and extending through a portion of the vertical portion of the second lateral sidewall and a portion of the second laterally extending shelf element, wherein each elongate slot of the at least two elongate slots of the second lateral sidewall is entirely encompassed and bounded by a portion of the second lateral sidewall and a portion of the second laterally extending shelf element, and wherein each tab of the at least two outwardly extending left tabs is received in one elongate slot of the at least two elongate slots of the second lateral sidewall to support the floor element;

a second laterally extending front mounting element extending outwardly from the second lateral sidewall in a direction perpendicular to the second lateral sidewall and opposite to the second laterally extending shelf element, wherein the second laterally extending front mounting element is coupled to the front sidewall of the floor element; and a second laterally extending rear mounting element extending inwardly from the second lateral sidewall in a direction perpendicular to the second lateral sidewall and opposite to the second laterally extending front mounting element, wherein the second laterally extending rear mounting element is coupled to the rear sidewall of the floor element; and a locking mechanism coupled to the front sidewall of the floor element for retaining and securing the drawer assembly in a predetermined orientation within a cabinet, the locking mechanism comprising:

a first latching member positioned on a first lateral portion of the front sidewall of the floor element;

a second latching member positioned on a second lateral portion opposing the first lateral portion of the front sidewall of the floor element;

a first handle coupled to the first latching member; and a second handle coupled to the second latching member, the first handle being positioned proximate the second handle, wherein the first handle and the second handle are configured for displacement toward one another to unlatch the first latching member and the second first latching member.

* * * * *